US006817913B1

(12) United States Patent
Witham

(10) Patent No.: US 6,817,913 B1
(45) Date of Patent: Nov. 16, 2004

(54) RECUMBENT QUADRIMANUAL FORWARD-ROWING DEVICE

(75) Inventor: Tracy Don Witham, Sauk Rapids, MN (US)

(73) Assignee: Tracy D. Witham, Sauk Rapids, MN (US)

( * ) Notice: Subject to any disclaimer, the term of this patent is extended or adjusted under 35 U.S.C. 154(b) by 0 days.

(21) Appl. No.: 10/602,449

(22) Filed: Jun. 24, 2003

(51) Int. Cl.[7] ..... B63H 16/67
(52) U.S. Cl. ..... 440/105
(58) Field of Search ..... 440/102, 104, 440/105, 101

(56) References Cited

U.S. PATENT DOCUMENTS

| | | | |
|---|---|---|---|
| 5,215,482 | A | 6/1993 | Henry |
| 5,248,272 | A | 9/1993 | duPont |
| 5,647,782 | A | 7/1997 | Henry |
| 5,685,750 | A | 11/1997 | Rantilla |
| 6,109,988 | A | 8/2000 | Dunn, Jr. |

OTHER PUBLICATIONS www.powerlifting.com/records (Men's Open–Women's Open).

*Primary Examiner*—Jesus D. Sotelo

(57) ABSTRACT

A device for facilitating direct arm-and-leg-tandem production of forward-facing rowing is disclosed. It comprises, briefly and generally, as thrust abutment and reclined back rest (30) and seat (40) tilted back to accommodate a convenient placement of handle-and-pedal assembly (50) for one rowing the device. Handle-and-pedal assembly (50) components are attached to oars for one to use in directly powering a watercraft forward by rowing. Oars (70) pivot by means of pair of connected pivotal axes (60). Pair of connected pivotal axes (60)—one pair to each oar—facilitate moving oars (70) through arcs originating with two axes, one longitudinally positioned and the other vertically positioned. The axes (60) are designed to be strong enough to prevent torquing when pedal (58) and pedal bar (56) are attached to the oars as part of handle-and-pedal assembly (50). Handle-and-pedal assembly (50) components operated in conjunction with an overall design which makes their use possible, thus, allow oars (70) to be pushed through the stroke phase of the rowing motion with arms and legs working together, using substantially the same rowing motion as is used in traditional rowing, but in reverse. The present invention thereby facilitates direct arm-and-leg-tandem production of forward-facing rowing of a watercraft.

1 Claim, 4 Drawing Sheets

RECUMBENT QUADRIMANUAL FORWARD-ROWING DEVICE

BACKGROUND OF THE INVENTION

Field of Invention

This invention pertains to rowed watercraft by facilitating direct arm-and-leg-tandem production of forward-facing rowing.

BACKGROUND OF THE INVENTION

Traditional rowing of a watercraft possesses the advantages of utilizing simple rowing apparatus and of those rowing apparatuses being intuitively obvious and satisfactorily effective to use: With traditional oarlocks serving as fulcrums the oars function as first class levers to which the rower directly applies force by pulling on the oar handles after the oar blades have been lowered into the water. The advantages are clear enough for the basic means of traditional rowing to have been in continual use for millennia. Nevertheless, traditional rowing also possesses two obvious disadvantages. First, it propels the rower backwards, and second, it limits the force that can be applied to the oars to that which the rower can exert directly through the hands in pulling on the oar handles. Overcoming these two disadvantages, whether singly or together, has been the goal of prior inventions.

Forward-facing rowing, considered singly, was a goal of U.S. Pat. No. 5,215,482 issued June 1993, to Henry; and U.S. Pat. No. 5,248,272 issued September 1993, to duPont, to cite recent examples. Henry's 1993 innovation achieves forward-facing rowing while basically preserving traditional rowing technique by means of placing a direction transfer mechanism between two first class levers, allowing the first class lever on the handle end to pivot against the inside end of the other first class lever so that the blade end of the oar propels the watercraft in the opposite direction it would otherwise, which is to say, forward. DuPont's 1993 innovation makes use of mechanical devices such as gears, torque shafts, looms, and a linkage assembly to accomplish forward-facing rowing.

However, no prior invention employs the admittedly obvious strategy of simply reversing the rowing motion to accomplish forward-facing rowing (that is, pushing the oar handle through the stroke phase of the rowing motion, rather than pulling it through the stroke phase as in traditional rowing). The obviousness of the "solution" by itself is sufficient to explain why no prior art claims it as an invention, but there are further reasons. One problem with simply reversing the rowing motion is that the rower can no longer use her feet to push against the hull floor as a thrust abutment in support of the rowing motion while remaining seated in a watercraft. Though by supporting the back one can provide an alternative thrust abutment for use in forward-facing rowing, making use of that strategy would decrease the power applied to the oars by removing the force which is exerted by the back in traditional rowing. Alternatively, the rower could stand, thereby sacrificing the stability of a small watercraft; or the rower could lean forward from a seated position to row, thereby creating an uncomfortable and awkward rowing posture. The simple solution creates problems as large or larger than the problem it solves. Therefore, more complicated solutions, such as those cited, have been invented.

That traditional rowing limits the force that can be applied in propelling a watercraft to that which the rower can exert through the hands alone has also spurred prior inventions that have combined a strategy to add leg power to the oars which is not conducted through the hands with a strategy to achieve forward-facing rowing. U.S. Pat. No. 5,647,782 issued July, 1997, to Henry; U.S. Pat. No. 5,685,750 issued November, 1997, to Rantilla; and U.S. Pat. No. 6,109,988 issued August, 2000, to Dunn, Jr., are recent examples. Henry's 1997 invention adds leg power to oars without directing it through the rower's hands by means of a slidable inboard support assembly holding a support post and mounting bracket which is powered by the rower's legs and feet. To accomplish this both inboard and outboard support assemblies are used in conjunction with dual pivot elements, an oar brace, and a stretcher assembly in addition to foot supports and an oarlock assembly. Rantilla's 1997 invention uses cord attachments and pulleys and associated apparatuses to operate the oars. Dunn, Jr.'s invention also uses pulleys and associated apparatuses to operate the oars.

Again, no prior invention employs the simplest strategy, in this case adding a pedal attachment to the oars so that the rower can directly power the rowing motion with the use of the arms and legs together, instead of with the arms alone. And again, problems which arise upon considering the simple solution seemingly make it impracticable: attaching a pedal to the handle on traditional rowing apparatuses would cause transverse torquing of the oar and oarlock which would render the rowing ineffective and could break the oar or oarlock. Furthermore, any downward motion of the attached oar pedal which would be needed to swing the oar blade out of the water in the recovery phase of the rowing motion, would be blocked by the hull floor, unless the boat seat were raised, in which case the boat would become unstable unless the boat were large. In that case the advantage of adding leg power would be lost in that the greater force generated would be used up, in part or whole, on moving a larger watercraft. Moreover, an attempt to adjust handles far enough back to stay within reach when the legs are extended against the pedals can cause the handles to be placed behind the rower when the rower retracts the pedals to set up the next stroke. Again, the simplest solution creates problems as large or larger than the problem it solves. Therefore, more complicated solutions, such as those cited, have been invented.

No prior art employs strategies to achieve effective forward-facing rowing by simply reversing the rowing motion. Nor does any prior art achieve arm-and-leg-tandem production of the rowing motion by directly affixing a pedal attachment to the oars.

BACKGROUND OF THE INVENTION—OBJECTS AND ADVANTAGES

The present invention has as objects and advantages:

(a) providing design solutions making effective forward-facing rowing of a watercraft possible by simply reversing the rowing motion, b) providing design solutions making it possible to add pedal bars and pedals directly to watercraft oars so that a rower can add force generated through the legs and feet directly to that generated through the arms and hands, (c) to provide a recumbent seat for the rower to recline in while rowing; and (d) to provide advantageous body mechanics to the rower by means of the recumbent seating position: as one moves the handles and pedals into place to begin the stroke phase of the rowing motion when using the present invention, one's torso is positioned relative to one's legs as when one crouches forward to stand up or crouches down to jump.

The crouch position just described above produces body mechanics by which a healthy person can generate 50–70% more force during the stroke phase of a rowing motion than is possible for the same healthy person using a racing scull.

SUMMARY

With a recumbent seat positioned relative to handle-and-pedal assemblies directly attached to oars in such a way that a rower can produce maximum power for rowing a water craft, the present invention facilitates direct arm-and-leg-tandem production of forward-facing rowing.

DRAWINGS - FIGURES

FIG. 1 provides a perspective view of a preferred embodiment of the present invention mounted on two hulls.

Figure 1:
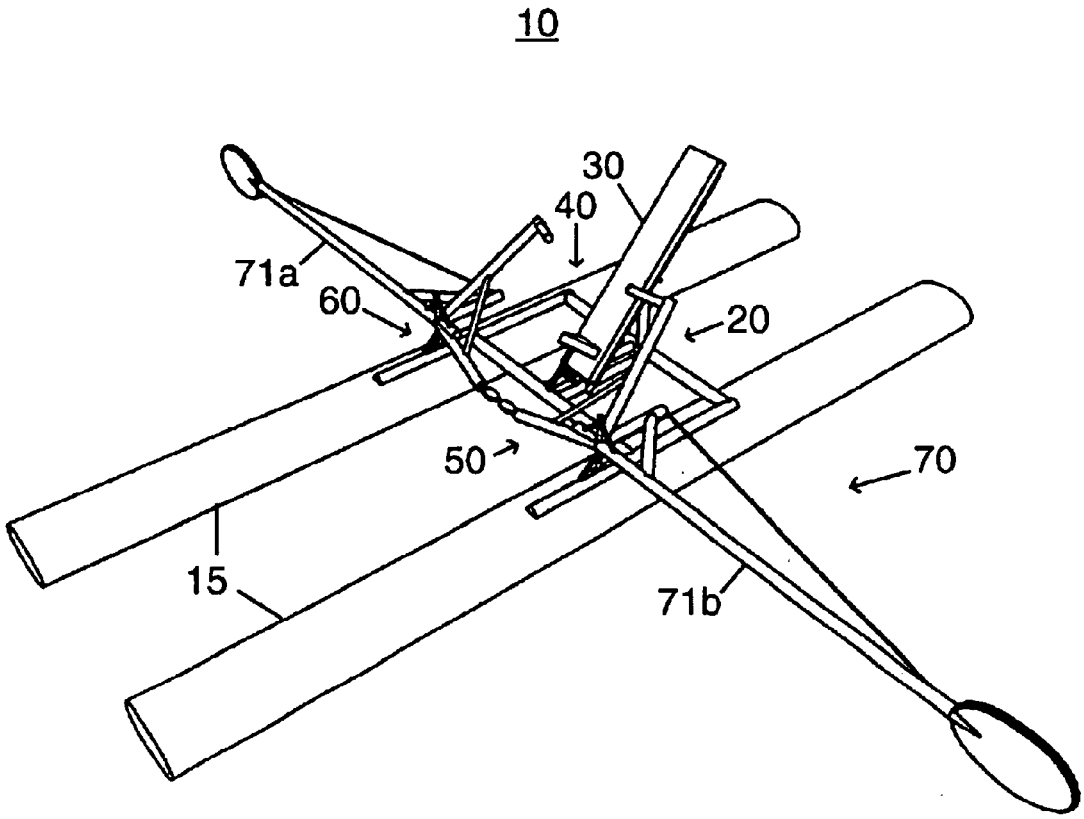

| DRAWINGS - Reference Numerals | |
|---|---|
| 10 | apparatus |
| 15 | hulls |
| 20 | apparatus support structure |
| 22 | starboard hull-mounted frame |
| 24 | port hull-mounted frame |
| 26 | fore connecting bar |
| 28 | aft connecting bar |
| 29a | starboard support bar |
| 29b | port support bar |
| 30 | thrust abutment and reclined back rest |
| 32 | thrust abutment frame |
| 34 | reclined back rest |
| 36 | thrust abutment brace |
| 40 | seat |
| 42 | main seat post |
| 44a | starboard seat post |
| 44b | port seat post |
| 50 | handle-and-pedal assembly |
| 52 | handle bar |
| 54 | handle |
| 55 | assembly connecting brace |
| 56 | pedal bar |
| 58 | pedal |
| 60 | pair of connected pivotal axes |
| 62 | longitudinally positioned pivotal axis |
| 64a | fore axis brace |
| 64b | aft axis brace |
| 65a | axis cap |
| 65b | axis cap |
| 65c | axis cap |
| 66 | vertically positioned pivotal axis |
| 68a | outer axis brace |
| 68b | inner axis brace |
| 70 | oars |
| 71a | starboard oar |
| 71b | port oar |
| 72 | oar-support spar |
| 74 | spar brace |
| 76 | oar support cable |
| 78 | blade |

DETAILED DESCRIPTION

FIGS. 1, 2, 3, and 4—Preferred Embodiment

For a better understanding of this invention, the following description should be read with the accompanying drawings in view. In referring to this invention and the parts which it comprises, the reference numerals provided above shall be used throughout the following description. I refer now to FIG. 1. There depicted is a perspective view of the preferred embodiment of the present invention as seen from above the port side of the craft and to the fore. The preferred embodiment generally, referred to as apparatus 10, is depicted attached to hulls 15. (The design of hulls 15 is not relevant beyond what is necessary to indicate that apparatus 10 is attached to a watercraft.) Apparatus 10 comprises these major components: apparatus support structure 20; a thrust abutment and reclined back rest 30; a seat 40; a handle-and-pedal assembly 50—one each to starboard and to port side; a pair of connected pivotal axes 60—one each to starboard and to port side; and oars 70, of which a starboard oar 71*a* and a port oar 71*b* are indicated.

Figure 2:
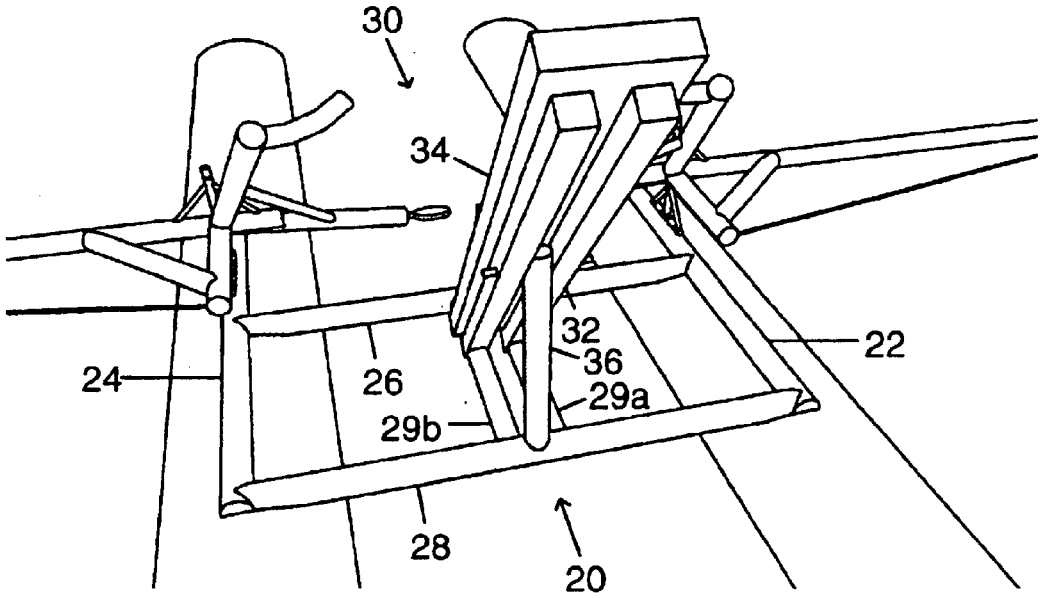
FIG. 2 shows the present invention from a rear perspective view which brings structural support components into focus.

FIG. 2 shows apparatus support structure 20 and a rear perspective of thrust abutment and reclined back rest 30: embedded in hulls 15 are a starboard hull-mounted frame 22 to the right and a port hull-mounted frame 24 to the left. Connecting starboard and port hull-mounted frames 22 and 24 are a fore connecting bar 26 and an aft connecting bar 28. Running parallel with each other and with starboard and port hull-mounted frames 22 and 24 are a starboard support bar 29*a* and a port support bar 29*b*. Starboard support bar 29*a* and port support bar 29*b* extend from fore connecting bar 26 to aft connecting bar 28; support bars 29*a* and 29*b* are centered between starboard and port hull-mounted frames 22 and 24. A reclined back rest 34 sits on starboard and port support bars 29*a* and 29*b* behind fore connecting bar 26. Reclined back rest 34 tilts back to sit at about a 45 degree angle relative to support bars 29*a* and 29*b*. A thrust abutment frame 32 attaches to starboard and port support bars 29*a* and 29*b*. Thrust abutment frame 32 holds reclined back rest 34 in place. A thrust abutment brace 36 positions thrust abutment frame 32 to set up optimal body mechanics for one using apparatus 10.

Figure 3:
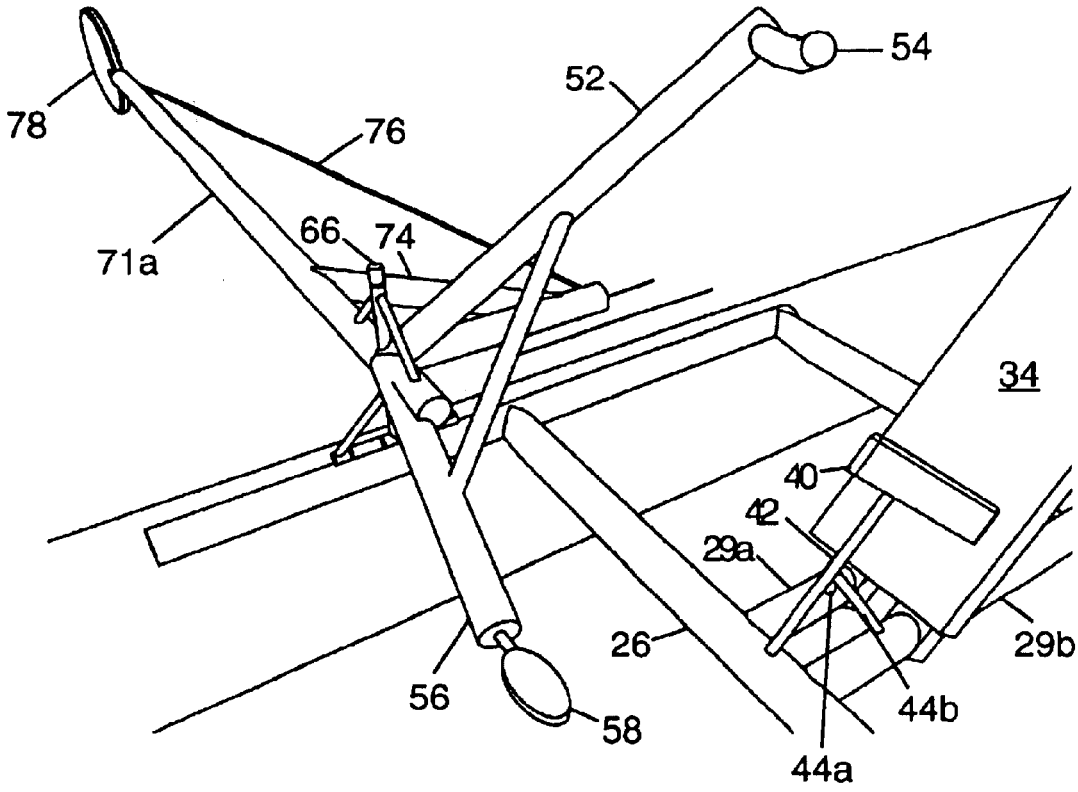
FIG. 3 shows a partial perspective of the present invention depicting the starboard-side and center of the apparatus from an elevated front, port-side view.

FIG. 3 shows seat 40 mounted by means of a main seat post 42 to fore connecting bar 26 and by means of a starboard seat post 44*a* (seen better in FIG. 4) and a port seat post 44*b* to starboard and port support bars 29*a* and 29*b* respectively. Seat 40 is angled back so that its top surface forms about a 90 degree angle with reclined back rest 34.

Shown only on the starboard side, handle-and-pedal assembly 50 comprises: a handle 54 connected by means of a handle bar 52 above and behind starboard oar 71*a*; a pedal 58 connected by means of a pedal bar 56 to the fore and below starboard oar 71*a*; and a connecting brace 55, which reinforces handle-and-pedal assembly 50 between handle bar 52 and pedal bar 56.

Figure 4:
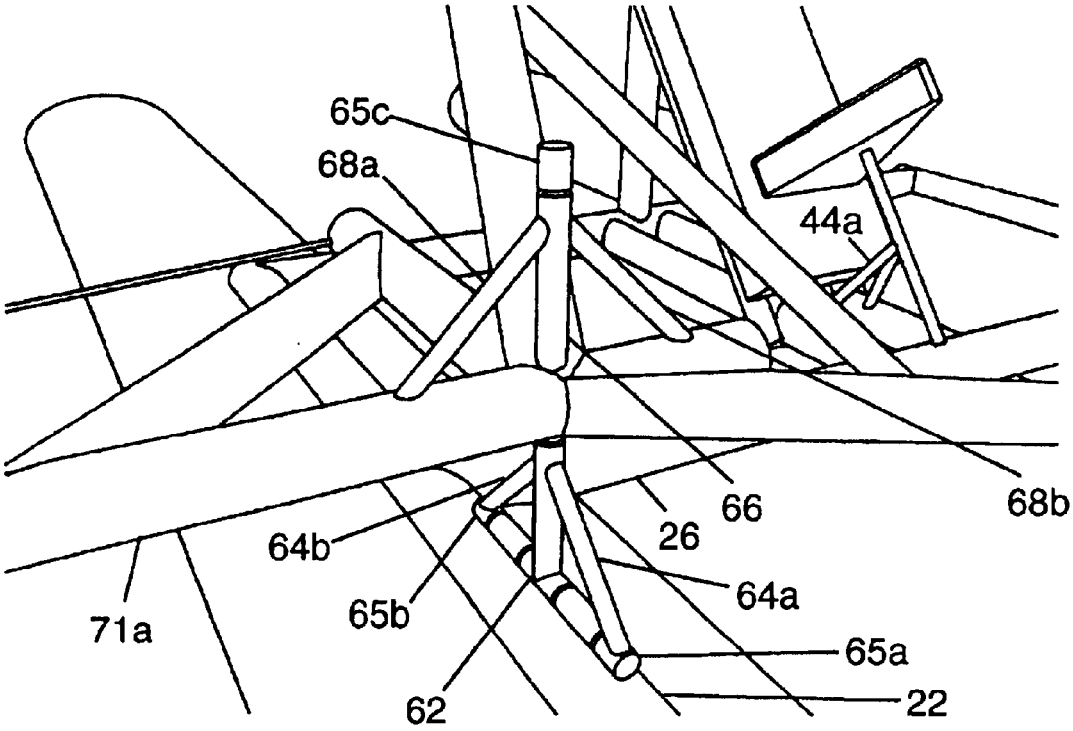
FIG. 4 shows a partial perspective of the present invention detailing the starboard side from an elevated front, starboard-side view.

Also on the starboard side, starboard oar 71*a* mounts on a vertically-positioned pivotal axis 66—which is viewed better in FIG. 4 than in FIG. 3—and comprises the following description. To the aft side of where oar 71*a* mounts on vertically positioned pivotal axis 66 an oar-support spar 72 projects to the aft of apparatus 10. Oar support spar 72 is positioned at a right angle to oar 71*a*. A spar brace 74 forms a hypotenuse to the right angle formed by oar 71*a* and oar-support spar 72. Spar brace 74 declines from the aft end of oar-support spar 72 toward a blade 78 of oar 71*a*. An oar-support cable 76 stretches from aft end of oar-support spar 72 to blade 78.

Exact mirror images are found on the port side of apparatus 10 both of handle-and-pedal assembly 50 on the starboard side and of starboard oar 71*a* (see 71*b* in FIG. 1).

Apparatus 10 is sufficiently disclosed by now to explain a crucial design feature. The backward tilt to thrust abutment and reclined back rest 30 does more than provide comfort and set up advantageous body mechanics for one who rows apparatus 10. Without a backward tilt to major component 30, placing handle 54 above and behind pedal 58 on handle-and-pedal assembly 50, to a degree amenable with normal human anatomy, would cause handle 54 to be positioned behind back rest 34 when pedal 58 is retracted. Apparatus 10 would thus be rendered useless. Apparatus 10 cannot be used effectively without thrust abutment and reclined back rest 30. Therefore, the backward tilt to thrust abutment and reclined back rest 30 is essential to the design structure of the present invention.

FIG. 4 shows a longitudinally positioned pivotal axis 62 attached to starboard hull-mounted frame 22 in front of fore connecting bar 26. Connected at a right angle to, and centered on longitudinally positioned pivotal axis 62, is vertically positioned pivotal axis 66. A fore axis brace 64*a* and an aft axis brace 64*b* reinforce vertically positioned pivotal axis 66. Fore axis brace 64*a* extends from an axis cap 65*a* to a position just below starboard oar 71*a* on axis 66. Aft axis brace 64*b* extends from an axis cap 65*b* to a position just opposite where fore axis brace 64*a* connects to vertically positioned pivotal axis 66. Oar 71*a* mounts on axis 66 just above fore and aft axis braces 64*a* and 64*b*. An outer axis brace 68*a* extends from a position on axis 66 above oar 71*a* to a position just beyond axis 66 on oar 71*a* to the outboard side. An inner axis brace 68*b* extends from a position on axis 66 above oar 71*a* to a position on the inboard side of axis 66 on oar 71*a*. An axis cap 65*c* secures oar 71*a* on axis 66. A mirror image of the pair of connected pivotal axes 60, exactly as described on the starboard side except for being a mirror image, is found on the port side of the present invention.

Operation—FIGS. 1, 2, 3, and 4

One rows apparatus 10 while sitting in seat 40 with one's back supported by thrust abutment and reclined back rest 30 and using, to both starboard and port sides, handle 54 and pedal 58 of handle-and-pedal assembly 50 components attached to oars 70. Everyone familiar with the art of rowing a boat knows the rowing motion used in traditional rowing. Therefore, it is sufficient to describe the use of apparatus 10 to say: With one's hands and feet used together to operate the handle-and-pedal assembly 50 components on both the starboard and port sides, one moves oars 70 through the same basic trajectory taken by oars in the course of traditional rowing. The only substantial difference is that oars 70 are pushed through the stroke phase of the rowing motion, rather than pulled, and accordingly, they are pulled into place to begin the next stroke—rather than pushed as is the case in traditional rowing. Because one reverses the direction of the oars in using apparatus 10 relative to the movement of the oars in traditional rowing, one also reverses the direction one travels in a rowboat relative to traditional rowing: from backwards to forwards. The operation of the present invention thereby facilitates direct arm-and-leg-tandem production of forward-facing rowing of a watercraft.

Conclusion, Ramifications, and Scope

The preferred embodiment of the present invention is depicted mounted on two hulls (a catamaran). A small single-hulled rowboat would not allow for moving the pedals downward, as is necessary in the recovery phase of the rowing motion, unless the rower were seated higher than is usual in the watercraft. Sitting higher above the hull, however, would adversely affect the stability of a small watercraft. Alternatively, a single-hulled watercraft could be made large enough for the loss of stability to be negligible, in which case the greater size of the boat would offset some of the advantages afforded by the present invention. Nevertheless, circumstances can easily be imagined which would call for a larger hull or hulls than those represented in the ideal embodiment. Examples include building a craft for two or more rowers or designing a cargo-carrying craft, in which case the larger hull or hulls would not constitute a disadvantage for the present invention. However, that the present invention does not present alternative embodiments depicting it adapted for a larger hull or for an alternatively shaped hull or hulls clearly does not limit the scope of the present invention to use with a small, two-hulled water craft: The possibility of using the present invention with many different hull configurations is obvious.

The present invention also shows fixed handle-and-pedal assemblies with fixed bar angles and bar lengths set up for the handle bars and pedal bars. (A prototype of the present invention works well with rowers ranging in height from 5'0" to 6'5".) Though at some time in the future it might be desirable to make bar angles and bar lengths adjustable, so that exceptionally tall or short adults can operate the present invention more effectively, simply adding means for making such adjustments would constitute obvious, not innovative, additions.

It is clear by now that the present invention makes it possible to produce forward-facing rowing with direct arm-and-leg-tandem production of the rowing motion. The design of the present invention also has secondary benefits: It provides reclining comfort and advantageous body mechanics to the person using it. Thus, the present invention provides substantial benefits over prior art means of rowing a watercraft, which a person who would enjoy a better way to row a watercraft will want to consider.

Yet a nearly limitless number of design adaptations could be made to the present invention as depicted in the preferred embodiment. Changes might be made to accommodate the present invention to different rowers with different needs or desires or with different ends in mind: whether aesthetic in nature or manufacturing related or sporting related or job related or marketing related, etc. Specific possibilities are endless, and therefore impossible to list. It is clear, however, that any design which diverges from the present invention in some detail or details but makes use of the basic design claimed herein utilizes the present invention.

I claim:

1. A device for producing forward-facing rowing of a watercraft with direct arm-and-leg-tandem production of the rowing motion, comprising:

(a) a thrust abutment and reclined back rest of sufficient strength to withstand backward force generated by rowing a watercraft when one powers oars through the stroke phase of a rowing motion by pushing against a handle-and-pedal assembly with arm-and-leg-tandem action simultaneously on each of two handle-and-pedal assembly components, (b) said thrust abutment and reclined back rest and a seat, located to the fore of said thrust abutment and reclined back rest, being tilted backward sufficiently far to place a handle behind a pedal on each of two said handle-and-pedal assembly components to prevent said handle from extending beyond one's hand's reach when one's legs are extended against said pedal without thereby causing said handle to be positioned behind said thrust abutment and reclined back rest when one's legs are retracted and said pedals are pulled back, (c) said handle and pedal assembly components on the starboard side and said handle-and-pedal assembly components on the port side being positioned relative to each other and to positions of an apparatus support structure so that the trajectory of said handle-and-pedal assembly components when used to row said watercraft do not intersect at any point with positions occupied by each other or by components of said apparatus support structure, and (d) a pair of connected pivotal axes on the starboard side and a pair of connected pivotal axes on the port side, one axis of each said pair of connected pivotal axes to be pivotal on a longitudinal line parallel with a line bisecting the device from fore to aft, and the second axis of each said pair of connected pivotal axes to be pivotal on a vertical line relative to the orientation of the device when said oars are extended directly to the sides relative to the orientation of the device, each said pair of connected pivotal axes replacing comparitively small pivotal axes found in standard oar locks with pivotal axes large enough to withstand the force generated by arm-and-leg-tandem action powering one's rowing motion and of preventing transverse torquing of the longitudinal and vertical axes during one's rowing motion due to arm-and-leg-tandem action, whereby one can enjoy the benefit of rowing a watercraft in the direction one faces by simply pushing, rather than pulling, the oars through the stroke phase of the rowing motion, and whereby one gains greater power for rowing a watercraft by using direct arm-and-leg-tandem production of the rowing motion.

* * * * *